US007753439B2

(12) United States Patent
Akkad

(10) Patent No.: US 7,753,439 B2
(45) Date of Patent: Jul. 13, 2010

(54) FOLDING CHAIR

(75) Inventor: Benjamin S. Akkad, Brooklyn, NY (US)

(73) Assignee: Idea Nuova, Inc,, New York, NY (US)

( * ) Notice: Subject to any disclaimer, the term of this patent is extended or adjusted under 35 U.S.C. 154(b) by 0 days.

(21) Appl. No.: 12/053,176

(22) Filed: Mar. 21, 2008

(65) Prior Publication Data

US 2009/0236879 A1 Sep. 24, 2009

(51) Int. Cl.
*A47C 4/00* (2006.01)
*A47C 4/18* (2006.01)
*A47C 4/20* (2006.01)

(52) U.S. Cl. ..... 297/23; 297/55; 297/58

(58) Field of Classification Search ..... 297/23, 297/55, 58

See application file for complete search history.

(56) References Cited

U.S. PATENT DOCUMENTS

| | | | | |
|---|---|---|---|---|
| 2,381,574 | A | 8/1945 | Clarin | |
| 3,123,396 | A | 3/1964 | Searle | |
| 4,514,009 | A | 4/1985 | Vanderminden et al. | |
| 4,867,505 | A | 9/1989 | Parker | |
| 5,718,474 | A * | 2/1998 | Kojima et al. | 297/58 |
| 6,095,607 | A | 8/2000 | Wenzel | |
| 6,332,646 | B1 | 12/2001 | Tseng | |
| 6,669,281 | B1 | 12/2003 | Huang | |
| 7,014,264 | B2 * | 3/2006 | Alderman et al. | 297/55 X |
| 7,144,078 | B2 | 12/2006 | Hsieh | |
| 7,219,955 | B2 | 5/2007 | Lu et al. | |
| 2004/0245810 | A1 | 12/2004 | Tseng | |
| 2007/0029846 | A1 | 2/2007 | Cohen | |

* cited by examiner

*Primary Examiner*—Rodney B White
(74) *Attorney, Agent, or Firm*—Pantich Schwarze Belisario & Nadel LLP

(57) ABSTRACT

A folding chair that may be positioned in a folded position or a working position. The chair includes a front leg assembly that has first and second legs and a rear leg assembly that has third and fourth legs with first and second shafts slidably mounted therein. The first and second shafts are pivotably attached to the front leg assembly. A first cap is mounted on a pivot end of each of the third and fourth legs. A second cap is mounted on a proximal end of each of the first and second shafts. The second caps engage the first caps when the chair is in the working position and the first and second caps are spaced apart from each other when the chair is in the folded position. A locking assembly connects to at least one of the first and second shafts.

17 Claims, 4 Drawing Sheets

FOLDING CHAIR

BACKGROUND OF THE INVENTION

This invention generally relates to a folding chair and, more particularly, to a folding chair having a capped plunger joint to prevent potential damage to the legs of the chair and a push button safety lock for safely supporting the frame of the chair in a working position.

Folding chairs are well known in the art to provide for easier displacement and compact storage during non-use. Folding chairs typically consist of two sets of legs, front and rear, that are pivotally attached. A seat is also pivotally attached to the legs such that when the legs are separated, the seat is horizontal to the ground and can thus support a user. Typically, the front set of legs have a back rest that extends therebetween.

Conventional folding chairs typically have a linkage that extends between the front and rear sets of legs above the seat such that pivoting the seat to a vertical position pivots the rear set of legs into parallel arrangement with the front set of legs and seat in the folded position. The linkage is typically a thin rectangular cross-sectional bar of metal, that when brought toward alignment with the front and rear sets of legs, creates a crushing or cutting point for fingers and permits direct impact between the metal surfaces of the leg assemblies and/or the linkages. The potential for injury is especially true when the folding chair is sized for use by a child. Children typically do not have sufficient experience with using folding chairs and do not know or appreciate the finger danger at the joints when collapsing the chair.

As a result, folding chairs have been developed to include a plunger in the rear set of legs, thereby eliminating the potentially dangerous linkage. However, in order to prevent the rear set of legs from contacting and damaging the joints connecting the rear and front sets of legs a stepped shaft has been used or a specially shaped joint that extends past the pivot point to engage with the rear legs. Such a configuration requires expensive machined parts or a molded joint that is more likely to break.

It would therefore be desirable to provide a folding chair with an inexpensive and durable plunger joint that prevents the rear set of legs from contacting and damaging the joints. It is further desirable that the folding chair have a safety mechanism that prevents the chair from collapsing unintentionally.

BRIEF SUMMARY OF THE INVENTION

Briefly stated, the present invention is directed to a folding chair that may be positioned in a folded position or a working position and has front and rear leg assemblies. The front leg assembly includes first and second generally tubular legs. The rear leg assembly includes third and fourth generally tubular legs and first and second shafts. The first and second shafts each have a constant cross-sectional diameter. The first and second shafts are slidingly received within the third and fourth legs respectively. The rear leg assembly is positionable in the working position in which the first and second shafts extend outwardly from the third and fourth legs a first predetermined distance and the folded position in which the first and second shafts extend outwardly from the third and fourth legs a second predetermined distance. The second predetermined distance is greater than the first predetermined distance. A proximal end of each of the first and second shafts is pivotably attached to the front leg assembly. Pivot pins are mounted to the front leg assembly. The first and second shafts are pivotable about the pivot pins at the proximal ends. A first cap is mounted on a pivot end of each of the third and fourth legs. A second cap is mounted on the proximal end of each of the first and second shafts. The pivot pins extend through the second caps to secure the second caps to the proximal ends. The second caps engage the first caps when the first and second shafts are in the working position to prevent contact between the proximal ends of the first and second shafts and the front leg assembly. The first and second caps are spaced apart from each other when the first and second shafts are in the folded position. A seat has first and second lateral sides. Each side is pivotably connected to the front and rear leg assemblies. The seat is positioned on a plane that is generally parallel to the front and rear leg assemblies when the chair is in the folded position. A locking assembly is connected to at least one of the first and second shafts. The locking assembly has a spring biased lock knob that extends through an aperture in at least one of the third and fourth legs when the chair is in the working position. The lock knob is positioned entirely within one of the third and fourth legs when the chair is in the folded position.

In another aspect, the invention is directed to a folding chair that may be positioned in a folded position or a working position and has front and rear leg assemblies. The front leg assembly includes first and second generally tubular legs. The rear leg assembly includes third and fourth generally tubular legs and first and second shafts. The first and second shafts each have a constant cross-sectional diameter. The first and second shafts are slidingly received within the third and fourth legs, respectively. The rear leg assembly is positionable in the working position in which the first and second shafts extend outwardly from the third and fourth legs a first predetermined distance and the folded position in which the first and second shafts extend outwardly from the third and fourth legs a second predetermined distance. The second predetermined distance is greater than the first predetermined distance. Pivot pins are mounted to the front leg assembly. The first and second shafts are pivotable about the pivot pins at the proximal ends. First and second pivot joints are mounted to the first and second legs, respectively. The proximal ends of each of the first and second shafts are pivotably attached to the first and second pivot joints by the pivot pins, respectively. A first cap is mounted on a pivot end of each of the third and fourth legs. A second cap is mounted on the proximal end of each of the first and second shafts. The pivot pins extend through the second caps to secure the second caps to the proximal ends. The second caps engage the first caps when the first and second shafts are in the working position to prevent contact between the proximal ends of the first and second shafts and the first and second pivot joints. The first and second caps are spaced apart from each other when the first and second shafts are in the folded position. A seat has first and second lateral sides. Each side is pivotably connected to the front and rear leg assemblies. The seat is positioned on a plane that is generally parallel to the front and rear leg assemblies when the chair is in the folded position. A locking assembly is connected to at least one of the first and second shafts. The locking assembly has a spring biased lock knob that extends through an aperture in at least one of the third and fourth legs when the chair is in the working position. The lock knob is positioned entirely within one of the third and fourth legs when the chair is in the folded position.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
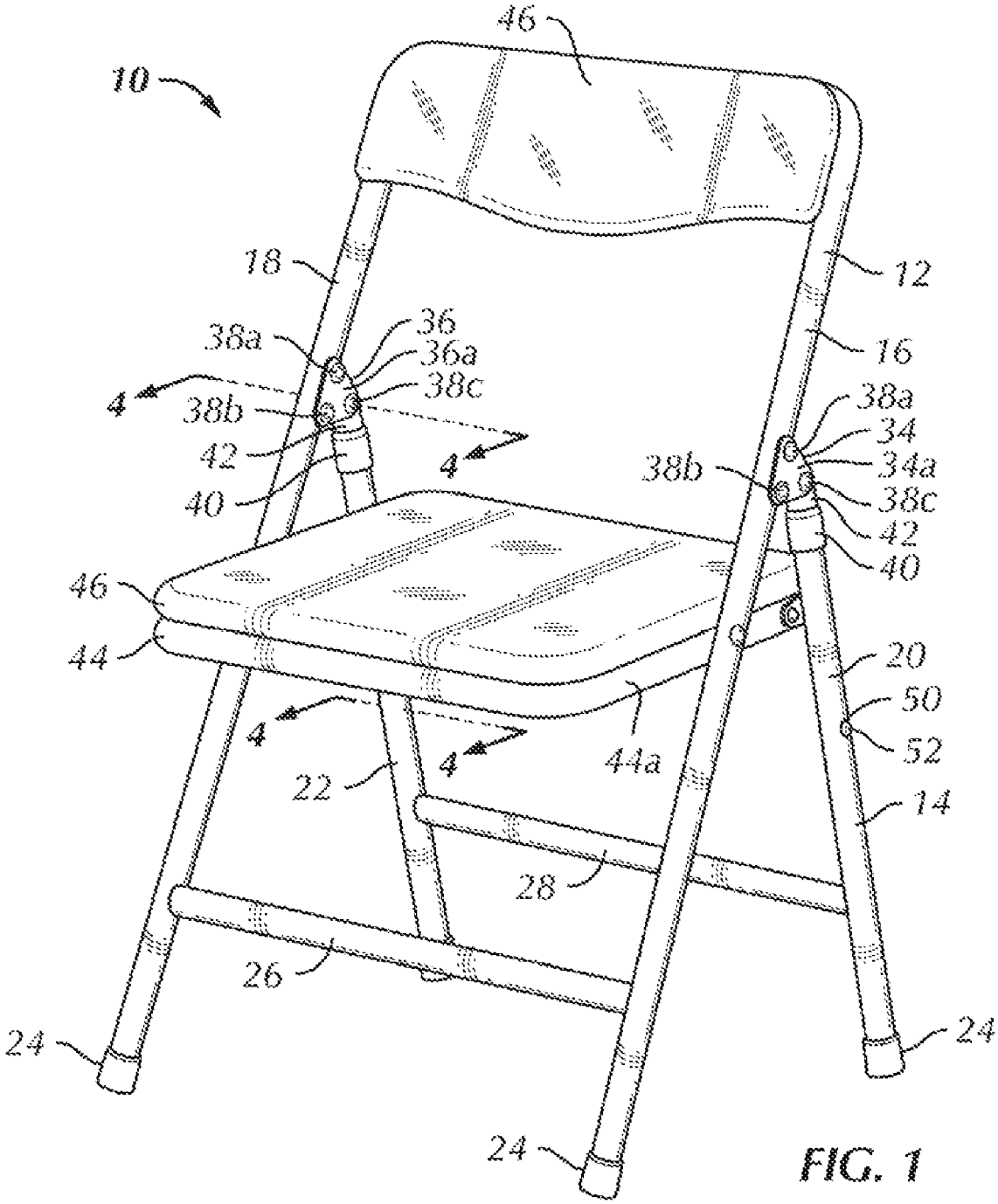
FIG. 1 is a front perspective view of a folding chair in accordance with a preferred embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of a folding chair in accordance with the present invention, and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings in detail, wherein like numerals indicate like elements throughout, there is shown in FIGS. 1-4, a preferred embodiment of a folding chair, generally designated 10. The folding chair 10 may be positioned in a folded position (FIG. 3) or a working position (FIG. 1).

Referring to FIG. 1, the folding chair 10 includes a U-shaped front leg assembly 12 and a rear leg assembly 14. The front leg assembly 12 is comprised of first and second legs 16, 18 and the rear leg assembly 14 includes third and fourth legs 20, 22. The first, second, third and fourth legs 16, 18, 20, 22 each preferably include a ground-contacting cap 24, but are not so limited and the caps 24 may not be mounted to the legs 16, 18, 20, 22. The ground-contacting caps 24 are preferably comprised of a polymeric material to prevent damage to any contacting surface and to close off the ends of the first, second, third and fourth legs 16, 18, 20, 22 but are not so limited and may be constructed of nearly any material. A first support crossbar 26 preferably extends between the first and second legs 16, 18 and a second support crossbar 28 preferably extends between the third and fourth legs 20, 22. The first and second support crossbars 26, 28 are positioned generally perpendicular to the first, second, third and fourth legs 16, 18, 20, 22 and help to give stability to the front and rear leg assemblies 12, 14, respectively. The first, second, third and fourth legs 16, 18, 20, 22 and first and second support crossbars 26, 28 are preferably, generally tubular in shape and are preferably comprised of a rigid metallic material such as aluminum. However, it is within the spirit Referring to FIGS. 3 and 4, the third and fourth legs 20, 22 include first and second shafts 30, 32 respectively. The first and second shafts 30, 32 preferably have a constant cross-sectional diameter D along their entire length and are each slidingly received within the third and fourth legs 20, 22 respectively. The first and second shafts 30, 32 are positionable between the working position (FIGS. 1 and 2) in which the first and second shafts 30, 32 extend outwardly from the third and fourth legs 20, 22 by a first predetermined distance L (FIG. 4) and the folded position (FIG. 3) in which the first and second shafts 30, 32 extend outwardly from the third and fourth legs 20, 22 by a second predetermined distance L' (FIG. 3). The second predetermined distance L' is greater than the first predetermined distance L.

Referring to FIGS. 1-4, a proximal end 30*a*, 32*a* of each of the first and second shafts 30, 32 is pivotably attached to the front leg assembly 12. In addition, first and second pivot joints 34, 36 are mounted to the first and second legs 16, 18, respectively. The first and second pivot joints 34, 36 are each preferably comprised of a pair of spaced-apart triangularly-shaped metal pieces 34*a*, 34*b* and 36*a*, 36*b*, respectively, to form a yoke. The first and second pivot joints 34, 36 preferably include two spaced-apart fasteners 38*a*, 38*b* and a pivot pin 38*c*. The fasteners 38*a*, 38*b* preferably secure the first and second pivot joints 34, 36 to the front leg assembly 12 and the pivot pins 38*c* pivotably secure the first and second pivot joint 34, 36 to the respective first or second shaft 30, 32. The two spaced-apart fasteners 38*a*, 38*b* and the pivot pin 38*c* of each pair of spaced-apart triangularly-shaped metal pieces 34*a*, 34*b* and 36*a*, 36*b* are disposed within an outer periphery of the respective metal pieces 34*a*, 34*b* and 36*a*, 36*b*. The first and second pivot joints 34, 36 are preferably stationary with a respect to the from leg assembly 12 while the first and second shafts 30, 32 are pivotably attached to the first and second pivot joint 34, 36, respectively. The pivot joints 34, 36 are not limited to the described, triangularly-shaped metal pieces 34*a*, 34*b* and 36*a*, 36*b* that generally form a yoke and may take on nearly any shape or configuration that pivotably secures the first and second shafts 30, 32 to the front leg assembly 12.

Figure 3:
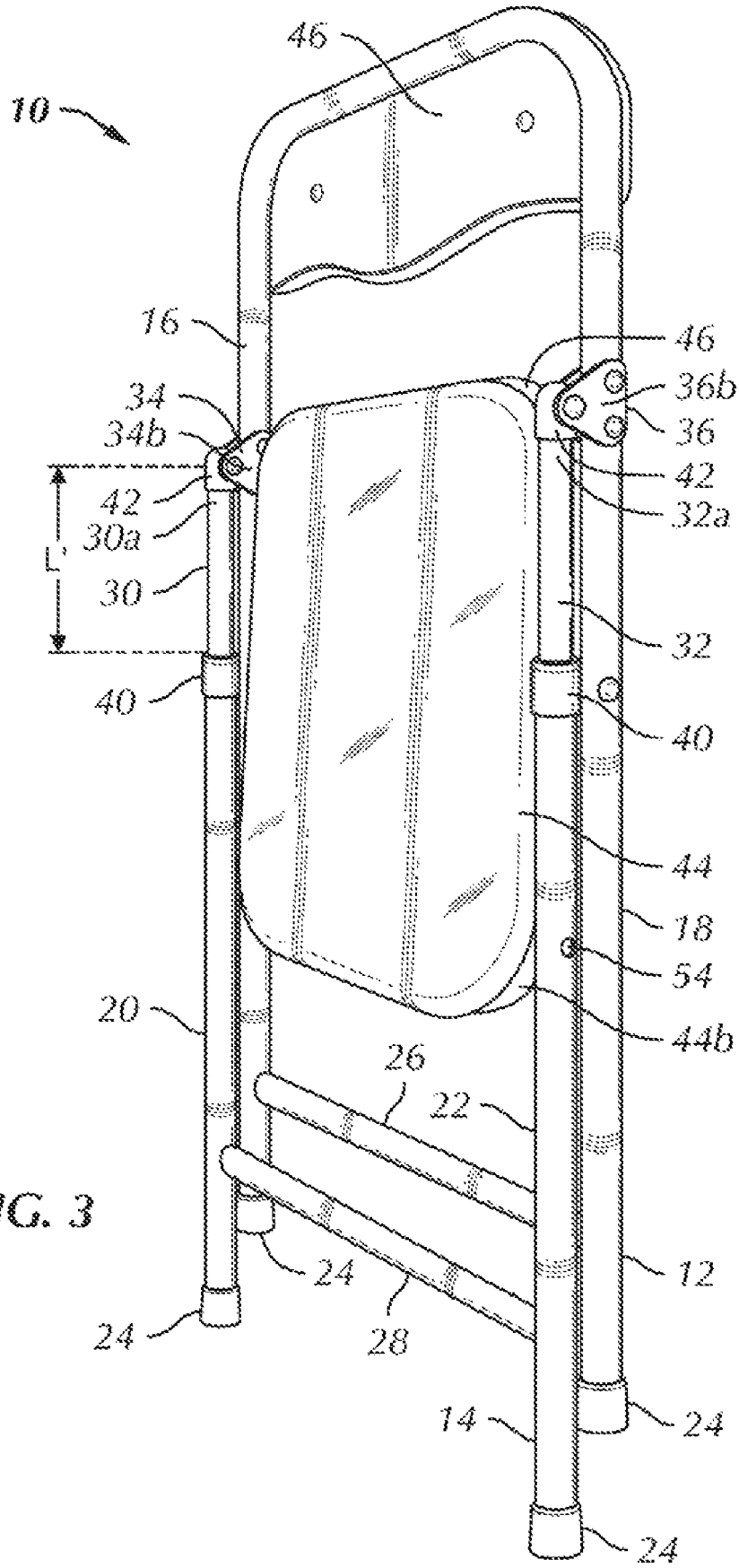
FIG. 3 is a rear perspective view of the folding chair shown in FIG. 1 in a folded position.
Figure 4:
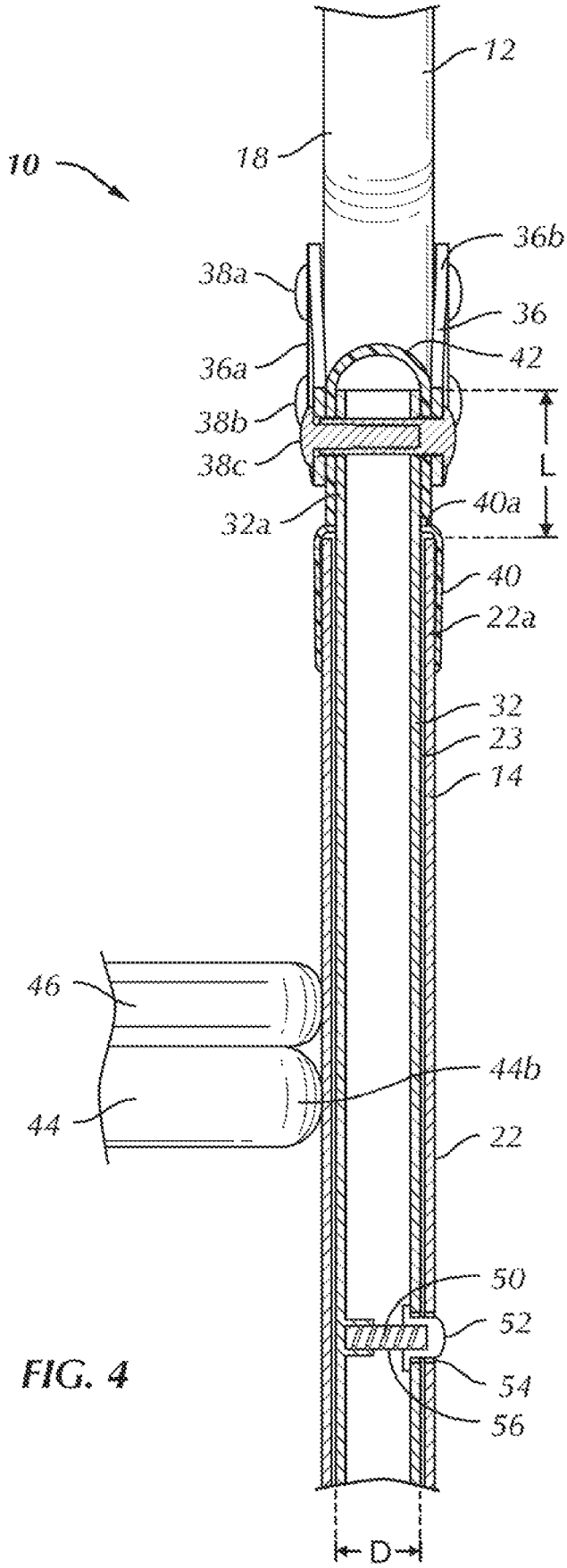
FIG. 4 is a partial cross-sectional view of the folding chair shown in FIG. 1, taken along lines 4-4 of FIG. 1.

A first cap 40 preferably comprised of a polymeric material is generally fixedly mounted on each of the third and fourth legs 20, 22 and is preferably comprised of a hollow polymeric sleeve that covers the pivot end 22*a* (FIGS. 3 and 4). The first caps 40 have a radially, inwardly extending upper lip 40*a* that forms a slidable seal between the third and fourth legs 20, 22 and the respective first and second shafts 30, 32. An inner diameter of the upper lip 40*a* being smaller than an inner diameter of the hollow sleeve and the hollow sleeve surrounds at least a portion of an exterior sidewall one of the third and fourth legs 20, 22 at the pivot end 22*a* thereof. The lip 40*a* contacts the third and fourth legs 20, 22 to prevent the proximal ends 22*a* from directly contacting the first and second shafts 30, 32, creating a metal to plastic contact rather than a metal to metal contact. The lip 40*a* also prevents dirt, dust and other objects from entering a relatively small gap 23 between the first and second shafts 30, 32 and the third and fourth legs 20, 22. Though it is preferred that the first caps 40 are comprised of a polymeric material, it is within the spirit and scope of the present invention that the first caps 40 be comprised of nearly any suitable material.

A second cap 42, preferably comprised of a polymeric material, is generally fixedly mounted on the proximal end of each of the first and second shafts 30, 32. The second caps 42 are preferably positioned between the pivot joints 34, 36 and the respective shaft 30, 32 and extend below the pivot pins 38*c* along the shaft 30, 32 such that the first and second caps 40, 42 engage with each other or abut each other when the folding chair 10 is in the working position (see FIG. 4). The pivot pins 38*c* extend through the second caps 42 to secure the second caps 42 to the proximal ends of the first and second shafts 30, 32. The engagement or abutment between the first and second caps 40, 42 prevents the rear leg assembly 14 from directly contacting the first and second pivot joints 34, 36 and/or the front leg assembly 12 to help prevent damage to the first and second pivot joints 34, 36 and/or the front leg assembly 12 to help reduce the potential for a pinched finger of a user. The first and second caps 40, 42 preferably engage with each other when the chair is in the working position and are spaced apart from each other when the chair 10 is in the folded position. Though it is preferred that the first and second caps 40, 42 engage in the working position, it is within the spirit and scope of the present invention that there is a gap between the first and second caps 40, 42 in the working position and the caps 40, 24 may engage if the chair 10 is opened or extended past the working position. Though it is preferred that the second caps 42 are comprised of a polymeric material, it is within the spirit and scope of the present invention that the second caps 42 be comprised of nearly any suitable material.

Figure 2:
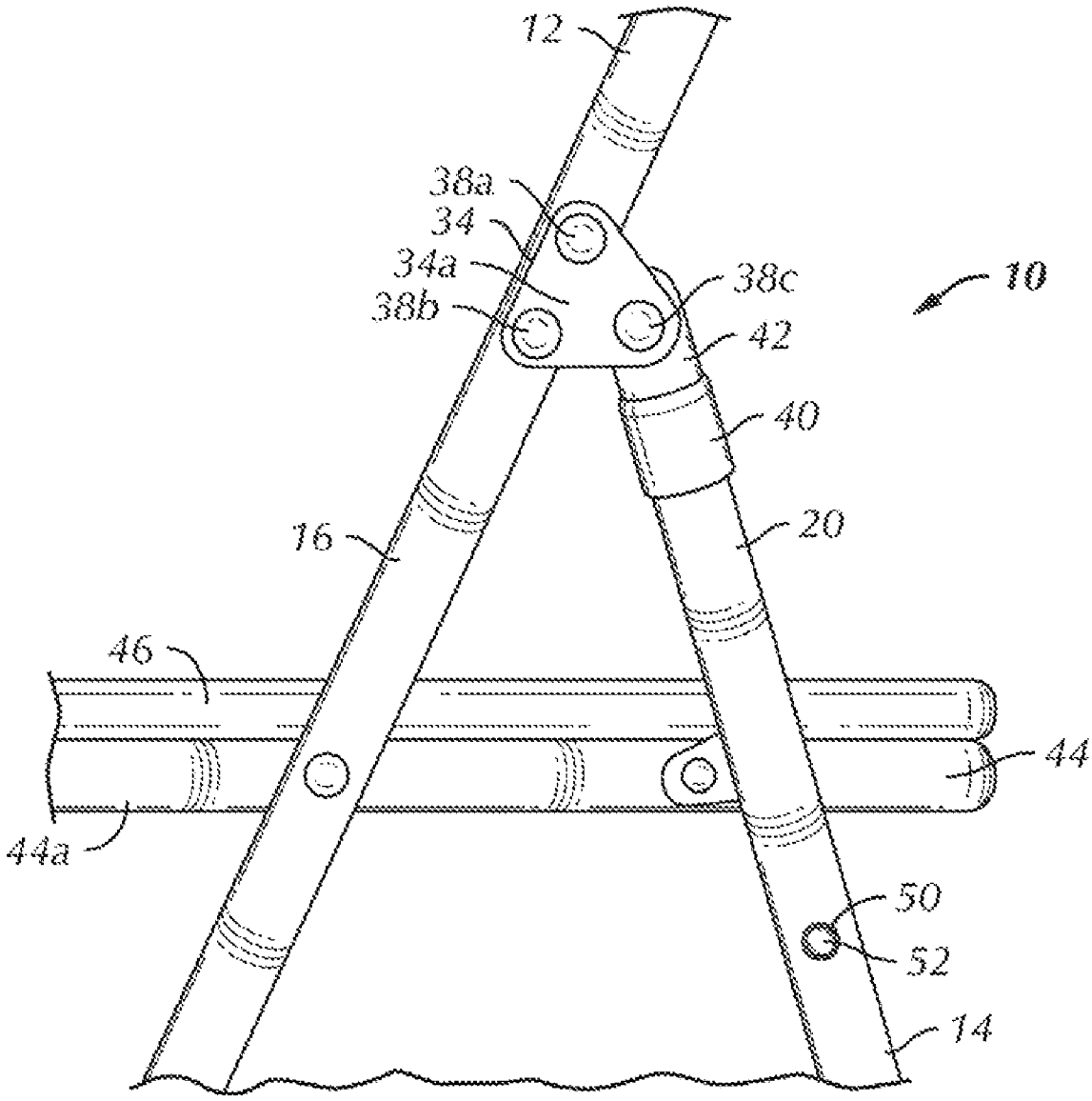
FIG. 2 is an enlarged, left side elevational view of a portion of the folding chair shown in FIG. 2.

Referring to FIGS. 1-3, the seat 44 has a first lateral side 44*a* and a second lateral side 44*b*. Each of the first and second lateral sides 44*a*, 44*b* is preferably pivotably connected to the front and rear leg assemblies 12, 14. The seat 44 is preferably generally parallel to the front leg assembly 12 when the chair is in the folded position and pivots to provide a horizontal sitting surface when the folding chair 10 is in the working position. The seat 44 preferably includes a padded cover 46, but is not so limited. The front leg assembly 12 also preferably includes a back rest 46 located toward the U-shaped top of the folding chair 10. The back rest 46 is also preferably padded.

Referring specifically to FIG. 4, the folding chair 10 includes a locking assembly 50 connected to the at least one of the first and second shafts 30, 32 and may be associated with both of the shafts 30, 32. The locking assembly 50 is comprised of a spring biased lock knob 52 that extends through an aperture 54 (seen best in FIG. 3) in the corresponding third or fourth leg 20, 22 when the folding chair 10 is in the working position. When the lock knob 52 is depressed or pushed through the aperture 54 and is positioned entirely within the corresponding third or fourth leg 20, 22, the first or second shaft 30, 32 becomes unlocked from the corresponding third or fourth leg 20, 22 such that the first and second shafts 30, 32 are slideable with respect to the third and fourth legs 20, 22, respectively. Returning the folding chair 10 to the working position aligns the lock knob 52 with the aperture 54 such that the spring 56 urges the lock knob 52 through the aperture 54, thereby locking the first or second shaft 30, 32 in the working position. As the folding chair 10 moves to and between the working and folding positions, the head of the lock knob 52 slides against an inside surface of the third or fourth legs 20, 22, respectively.

Referring to FIGS. 1-4, in operation, the user preferably approaches the chair 10 in the folded position, takes hold of the backrest 46 with one hand and urges the seat 44 downwardly with the other hand, pivoting the first and second leg assemblies 12, 14 apart and the first and second shafts 30, 32 down into the third and fourth legs 20, 22, respectively. The first and second shafts 30, 32 extend into the respective third or fourth leg 20, 22 until either the lock knob 52 engages with the aperture 54 or the first and second caps 40, 42 engage. Once the chair 10 is in the working position, the user may sit on the seat 44. When the user is done sitting in the chair 10, the chair 10 may be folded back into the folded position by pressing the lock knob 52 through the aperture 54 with one hand and pivoting the seat 44 with the other hand to unlock the second leg assembly 14 from the locking assembly 50. Once the locking assembly 50 is disengaged from the aperture 54, the user moves the hand used to depress the locking assembly 50 to the back rest 46 to pivot the seat 44 and the first and second leg assemblies 12, 14 into the folded position. Though the above described method for operating the chair 10 is preferred, it is within the spirit and scope of the present invention that the chair 10 may be moved between the folded and unfolded positions in any, alternative and suitable manner as would be apparent to one having ordinary skill in the art.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A folding chair that may be positioned in a folded position or a working position, the chair comprising:

a front leg assembly including first and second generally tubular legs;

a rear leg assembly including third and fourth generally tubular legs and first and second shafts, the first and second shafts each having a constant cross-sectional diameter along an entire length thereof, the first and second shafts slidingly received within the third and fourth legs, respectively, the rear leg assembly positionable in the working position wherein the first and second shafts extend outwardly from the third and fourth legs a first predetermined distance and in the folded position wherein the first and second shafts extend outwardly from the third and fourth legs a second predetermined distance, the second predetermined distance being greater than the first predetermined distance, a proximal end of each of the first and second shafts being pivotably attached to the front leg assembly;

a pivot pin mounted to the front leg assembly, the first and second shafts being pivotable about the pivot pin at the proximal ends;

a first cap generally fixedly mounted on a pivot end of each of the third and fourth legs, each first cap including a radially inwardly extending upper lip and a hollow sleeve depending downwardly therefrom, an inner diameter of the upper lip being smaller than an inner diameter of the hollow sleeve, the hollow sleeve surrounding at least a portion of an exterior of one of the third and fourth legs at the pivot end thereof;

a second cap generally fixedly mounted on the proximal end of each of the first and second shafts, the pivot pin extending through the second caps to secure the second caps to the proximal ends, the second caps engaging the first caps when the first and second shafts have been slid generally into the third and fourth legs, respectively, and are in the working position to prevent contact between the proximal ends of the first and second shafts and the front leg assembly, the first and second caps spaced-apart from each other when the first and second shafts have been slid generally out of the third and fourth legs, respectively, and are in the folded position;

a seat having first and second lateral sides, each side being pivotably connected to the front and rear leg assemblies, the seat being positioned on a plane that is generally parallel to the front and rear leg assemblies when the chair is in the folded position; and a locking assembly connected to at least one of the first and second shafts, the locking assembly having a spring biased lock knob extending through an aperture in at least one of the third and fourth legs when the chair is in the working position, the lock knob being depressible and positionable entirely within one of the third and fourth legs when the chair is in the folded position.

2. The folding chair of claim 1, further comprising:

a first support cross bar extending between the first and second legs and a second support cross bar extending between the third and fourth legs, the first and second support cross bars being positioned generally perpendicular to the first, second, third and fourth legs.

3. The folding chair of claim 1, wherein the seat includes a padded cover.

4. The folding chair of claim 1, wherein the front leg assembly has a generally U-shape and includes a backrest.

5. The folding chair of claim 4, wherein the backrest is padded.

6. The folding chair of claim 1, wherein the first, second, third and fourth legs each include a ground-contacting cap mounted to distal ends.

7. The folding chair of claim 1, wherein the first and second caps are made of a polymeric material.

8. The folding chair of claim 1, wherein the first, second, third and fourth legs and the first and second shafts are comprised of a metallic material.

9. A folding chair that may be positioned in a folded position or a working position, the chair comprising:

a front leg assembly including first and second generally tubular legs;

a rear leg assembly including third and fourth generally tubular legs and first and second shafts, the first and second shafts each having a constant cross-sectional diameter along an entire length thereof, the first and second shafts slidingly received within the third and fourth legs, respectively, the rear leg assembly positionable in the working position wherein the first and second shafts extend outwardly from the third and fourth legs a first predetermined distance and in the folded position wherein the first and second shafts extend outwardly from the third and fourth legs a second predetermined distance, the second predetermined distance being greater than the first predetermined distance;

first and second pivot joints being mounted to the first and second legs respectively, each pivot joint comprised of a pair of spaced-apart triangularly-shaped metal pieces, each pivot joint including two spaced-apart fasteners and a pivot pin, the two spaced-apart fasteners and the pivot pin of each pair of spaced-apart triangularly-shaped metal pieces being disposed within an outer periphery of the respective metal pieces, the fasteners being mounted to the first leg assembly and the pivot pin being mounted to a proximal end of one of the first and second shafts, the first and second shafts being pivotable about the pivot pins at the proximal ends such that the proximal ends of each of the first and second shafts are pivotably attached to the first and second pivot joints by the pivot pins respectively;

a first cap generally fixedly mounted on a pivot end of each of the third and fourth legs;

a second cap generally fixedly mounted on the proximal end of each of the first and second shafts, at least a portion of each second cap being positioned between one pair of the spaced-apart triangularly-shaped metal pieces of the first and second pivot joints, the pivot pin extending through the second caps to secure the second caps to the proximal ends, the second caps engaging the first caps when the first and second shafts have been slid generally into the third and fourth legs, respectively, and are in the working position to prevent contact between the proximal ends of the first and second shafts and the first and second pivot joints, the first and second caps spaced-apart from each other when the first and second shafts have been slid generally out of the third and fourth legs, respectively, and are in the folded position;

a seat having first and second lateral sides, each side being pivotably connected to the front and rear leg assemblies, the seat being positioned on a plane that is generally parallel to the front and rear leg assemblies when the chair is in the folded position; and a locking assembly connected to at least one of the first and second shafts, the locking assembly having a spring biased lock knob extending through an aperture in at least one of the third and fourth legs when the chair is in the working position, the lock knob being depressible and positionable entirely within one of the third and fourth legs when the chair is in the folded position.

10. The folding chair of claim 9, further comprising:

a first support cross bar extending between the first and second legs and a second support cross bar extending between the third and fourth legs, the first and second support cross bars being positioned generally perpendicular to the first, second, third and fourth legs.

11. The folding chair of claim 9, wherein the seat includes a padded cover.

12. The folding chair of claim 9, wherein the front leg assembly has a generally U-shaped top and includes a backrest.

13. The folding chair of claim 12, wherein the backrest is padded.

14. The folding chair of claim 9, wherein the first, second, third and fourth legs each include a ground-contacting cap mounted to distal ends.

15. The folding chair of claim 9, wherein the first and second caps are made of a polymeric material.

16. The folding chair of claim 9, wherein the first, second, third and fourth legs and the first and second shafts are comprised of a metallic material.

17. The folding chair of claim 9, wherein each first cap is comprised of a radially inwardly extending upper lip and a hollow sleeve depending therefrom, an inner diameter of the upper lip being smaller than an inner diameter of the hollow sleeve, the hollow sleeve surrounding at least a portion of an exterior of one of the third and fourth legs at the pivot end thereof.

* * * * *